US005642581A

United States Patent [19]

Herold et al.

[11] Patent Number: 5,642,581

[45] Date of Patent: Jul. 1, 1997

[54] MAGAZINE FOR A FIREARM INCLUDING A SELF-CONTAINED AMMUNITION COUNTING AND DISPLAY SYSTEM

[76] Inventors: Michael A. Herold, 367 High Grove Blvd., Akron, Ohio 44312; Mark D. Herold, 3980 Englewood Dr., Stow, Ohio 44224; George R. King, 3525 Cameo Dr. #96, Oceanside, Calif. 92056

[21] Appl. No.: 580,080

[22] Filed: Dec. 20, 1995

[51] Int. Cl.[6] ..... F41A 9/62

[52] U.S. Cl. ..... 42/1.02

[58] Field of Search ..... 42/1.01, 1.02, 42/1.03, 7, 50

[56] References Cited

U.S. PATENT DOCUMENTS

| | | | |
|---|---|---|---|
| 784,786 | 3/1905 | Gottardi | 42/1.02 |
| 1,202,768 | 10/1916 | Arnold . | |
| 2,828,568 | 4/1958 | Sakewitz | 42/1.02 |
| 3,552,053 | 1/1971 | Jarvis . | |
| 4,001,961 | 1/1977 | Johnson et al. . | |
| 4,146,987 | 4/1979 | Hudson et al. . | |
| 4,372,192 | 2/1983 | Lienau . | |
| 4,541,191 | 9/1985 | Morris et al. . | |
| 4,558,626 | 12/1985 | Bartolles . | |
| 4,587,756 | 5/1986 | Jakubaschk et al. . | |
| 5,005,307 | 4/1991 | Horne et al. . | |
| 5,052,138 | 10/1991 | Crain | 42/1.02 |
| 5,142,805 | 9/1992 | Horne et al. . | |
| 5,206,444 | 4/1993 | Oliver . | |
| 5,303,495 | 4/1994 | Harthcock | 42/1.02 |
| 5,425,299 | 6/1995 | Teetzel . | |
| 5,519,953 | 5/1996 | Villani | 42/1.02 |

OTHER PUBLICATIONS

"Accu–Counter: Revolutionizing Firearms." brochure published by Accu–Counter, Inc. 3314 Thomas Street, Erlanger, KY 41018 Date Unknown.

*Primary Examiner*—Michael J. Caroné
*Assistant Examiner*—Theresa M. Wesson
*Attorney, Agent, or Firm*—Oldham & Oldham Co., LPA

[57] ABSTRACT

An ammunition clip or magazine for a firearm including a self-contained system for sensing the amount of ammunition contained within the magazine and visually indicating that value to the user of the firearm. The counting and display system may be configured to display the number of rounds remaining in the magazine itself, or the number of rounds remaining in the firearm overall (the number of ammunition rounds in the magazine plus one round in the chamber of the firearm, if applicable), or it may be configured to simply indicate that the magazine is empty or that the number of rounds remaining in the magazine is below some other predetermined threshold. The magazine may be utilized in conjunction with any suitable firearm without modifying the firearm.

16 Claims, 4 Drawing Sheets

40
U1a-U1d
+Vcc
U2
A
B
C
D
LT
BI
LE
a
b
c
d
e
f
g
50
52
46
48
U3
U4
U1
30
D1-D21
17
42a-ℓ
20
44
45
25
26
27
10
15

MAGAZINE FOR A FIREARM INCLUDING A SELF-CONTAINED AMMUNITION COUNTING AND DISPLAY SYSTEM

FIELD OF INVENTION

The present invention relates to a magazine for a firearm, also known as a "clip", and more particularly to a magazine including a system for sensing the amount of ammunition contained within the magazine and visually indicating that value to the user of the firearm. The counting and display system may be configured to display the number of rounds remaining in the magazine itself, or the number of rounds remaining in the firearm overall (the number of ammunition rounds in the magazine plus one round in the chamber of the firearm, if applicable), or it may be configured to simply indicate that the magazine is empty or that the number of rounds remaining in the magazine is below some other predetermined threshold.

BACKGROUND OF THE INVENTION

A common problem associated with the use of firearms, especially automatic or semi-automatic firearms, is the inability of the user to easily and accurately determine the number of ammunition rounds remaining in the magazine or "clip" of the gun. In certain law enforcement and military situations for example, the law enforcement officer or soldier may need to know the precise amount of ammunition remaining in his or her weapon, or at the very least, that the number of rounds remaining is below some predetermined threshold. Also, gun enthusiasts and hunters have found a need and a desire for easily and accurately determining the number of live rounds of ammunition remaining in a weapon. A knowledge of the precise number of rounds remaining in a weapon, or an indication that live ammunition is present in the weapon is another safeguard to preventing accidental shootings.

Ammunition counting and display devices for firearms have been developed in an effort to provide law enforcement officers, military personnel, hunters, gun enthusiasts, and others with a mechanism for easily and accurately counting and displaying the number of rounds fired from a weapon, or the number of unfired rounds remaining in the weapon. However, none of these prior devices has proven to be satisfactory for accomplishing either of these tasks. These prior systems have generally been too complicated and have all required the firearm itself to be modified in some manner to accept the device. Many of the prior systems have required modifications to the grip, the slide mechanism, and the magazine mechanism of a weapon. Such modifications and complex installation requirements make it difficult and undesirable for many gun users to utilize these devices. Also, some of the prior devices add an unacceptable amount of bulk and weight to the firearm, resulting in a weapon that is more difficult to holster, aim, and fire.

Many of these prior ammunition counting systems utilize the movement of the slide mechanism of the firearm relative to the body of the firearm to count the number of times the weapon has been fired. There are several disadvantages to this approach. Any modification of the slide assembly, especially by a less experienced gun user, increases the likelihood of the slide assembly becoming jammed or otherwise malfunctioning. Also, these prior system that increment or decrement a counter based upon the movement of the slide necessarily require that the number of rounds initially present in the firearm is properly sensed or entered by the user. For example, one prior system assumes that the magazine will always be fully loaded when it is initially inserted into the weapon and therefore automatically sets the counter to "8" or some other predefined value. The counter is then decreased by "1" each time the slide moves relative to the gun body. It can be seen that should the magazine be loaded with less than eight rounds of ammunition when it is initially inserted in to the weapon, the number of rounds indicated on the display would be inaccurate, resulting in a dangerous and potentially deadly situation.

Another disadvantage with merely incrementing or decrementing a counter based upon movement of the slide mechanism is that should the device fail to properly sense the firing of the weapon, even once, the count will be inaccurate from that point on.

SUMMARY OF THE INVENTION

It is therefore an object of the present invention to provide an ammunition magazine for a firearm including a self-contained system for accurately sensing and displaying the number of rounds of ammunition remaining in the magazine.

It is another object of the present invention to provide an ammunition magazine for a firearm including a self-contained system for accurately sensing and displaying the number of rounds of ammunition in the firearm overall (the number of rounds in the magazine plus the round in chamber of the firearm).

It is a further object of the present invention to provide an ammunition magazine for a firearm including a self-contained system for accurately sensing and displaying the number of unfired ammunition rounds in the magazine, wherein the firearm does not need to be modified to accept the magazine.

It is still another object of the present invention to provide an ammunition magazine for a firearm including a self-contained system for accurately sensing and displaying the number of unfired ammunition rounds in the magazine, wherein the magazine and ammunition counting system do not interfere with the holstering and firing of the firearm.

Additional objects and advantages of the present invention will be set forth in the description which follows.

To accomplish the foregoing and other objects, the present invention comprises an ammunition magazine for use in a firearm, wherein the magazine includes a follower therein for supporting at least one round of ammunition within the magazine and a spring for biasing the follower toward an open end of the magazine. The magazine also includes sensing means for sensing the position of the follower within the magazine and an electronic circuit for determining and displaying the number of rounds of ammunition contained within the magazine based upon the position of the follower.

As ammunition is fired from the firearm, unfired rounds are taken from the open end of the magazine into the chamber of the firearm while empty ammunition cartridges or shells are ejected from the firearm. The follower therefore moves upward under the force of the follower spring. The sensing means senses the new position of the follower and the electronic circuit determines the number of rounds remaining in the magazine based upon the new position. The circuit includes a display element to be viewed by the gun user for displaying the number of rounds of ammunition remaining in the magazine. Alternatively, the numeric display element may be replaced by one or more indicator lamps or light emitting diodes that indicate the number of rounds of ammunition remaining in the magazine, or that the number of rounds has fallen below some predetermined threshold (for example, a red indicator light may be used to indicate that the magazine is empty). In the case where a firearm user fully loads the firearm, including the magazine and also inserts a round of ammunition into the chamber of the firearm, that user may want to increase the displayed count of ammunition by one to account for the round in the chamber. The present invention may therefore comprise means for consistently increasing the indicated amount of ammunition in the magazine by one to accurately indicate the number of rounds in the firearm overall.

DETAILED DESCRIPTION OF THE INVENTION

Figure 3:
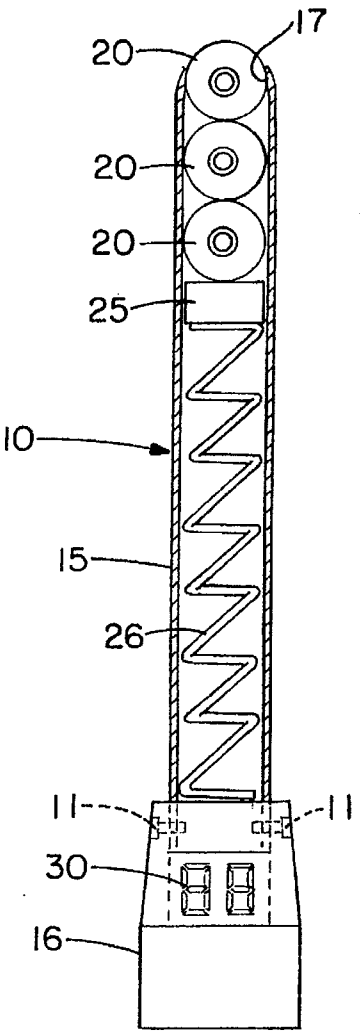
FIG. 3 is a rear view, partially in cross section and partially in elevation of the ammunition magazine shown in FIG. 2.

Reference will now be made in detail to the present preferred embodiments of the invention, examples of which are illustrated in the accompanying drawings. Wherever possible, the same reference numbers will be used throughout the drawings to refer to the same or like parts. Referring specifically to FIGS. 1–4, an ammunition magazine in accordance with the present invention, also known as a clip, is shown generally at 10 as it may be used in conjunction with a firearm such as a semi-automatic handgun 12 as shown. A magazine 10 in accordance with the present invention may be used with any firearm designed to accept a magazine or "clip" such as automatic and semi-automatic handguns and rifles, shotguns, and any other suitable firearm. Magazine 10 comprises a generally hollow upper storage portion 15 for containing a quantity of live ammunition rounds 20 such as bullets, cartridges, or shells. A gun user loads ammunition 20 into upper portion 15 of magazine 10 by pressing the cartridges or shells 20 downward into magazine 10 through a generally open top portion 17 as is well known in the field of firearms and ammunition magazines.

Hollow upper portion 15 of magazine 10 includes an ammunition follower 25, which is slidably positioned within hollow upper portion 15, for supporting the one or more rounds of ammunition 20 within upper portion 15 of magazine 10. Follower 25 is biased upward toward open top 17 of magazine 10 by a follower spring 26, and as ammunition rounds 20 are loaded into magazine 10, follower 25 is forced downward toward lower portion 16 of magazine, thereby compressing follower spring 26. After magazine 10 is inserted into firearm 12, firearm 12 is cocked, causing a round of ammunition 20 to be automatically removed through open top 17 of magazine 10 and positioned within the firing chamber 13 of firearm. Follower 25 simultaneously moves upward under the force of follower spring 26, thereby positioning a new round of ammunition 20 at open top 17 of magazine 10. At this point, if desired, magazine 10 may be once again removed from firearm 12 and an additional round of ammunition 20 may be inserted into open top portion 17 of magazine 10 before it is reinserted into firearm 12. Firearm magazine 10 will then be completely full, and a live round of ammunition 20 will also be present in chamber 13. This state, when chamber 13 contains a live round of ammunition 20, and when magazine 10 is also fully loaded, will hereinafter be referred to as the "plus one" state.

When the firearm 12 is fired, the empty ammunition cartridge is ejected from firing chamber 13, and a new round of ammunition 20 is automatically taken from open top 17 of magazine 10 and positioned in chamber 13. Follower 25 moves upward under force of follower spring 26 a distance equal to the width of the round of ammunition 20 removed from open top 17 of magazine 10. Firearm 12 may be repeatedly fired in this manner, and follower 25 will correspondingly move incrementally upward as described. It can be seen therefore that the location of follower 25 within hollow upper portion 15 of magazine 10 depends upon the number of ammunition cartridges 20 stored in magazine 10. It can also be seen that for any number of ammunition cartridges 20 loaded in upper portion 15 of magazine 10 (from zero to fully loaded) follower 25 will assume a unique position within upper portion 15 of magazine 10.

Figure 2:
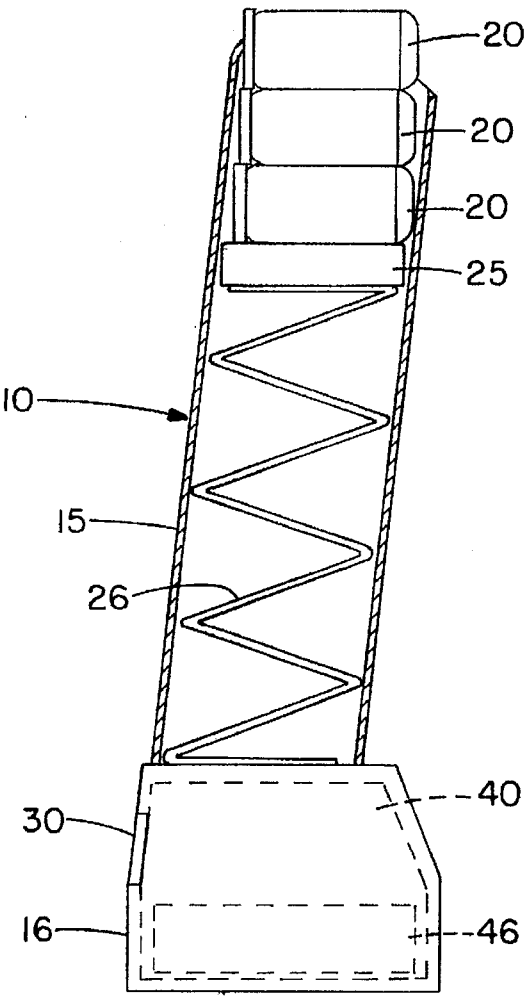
FIG. 2 is a side view in cross section of an ammunition magazine in accordance with the present invention.
Figure 1:
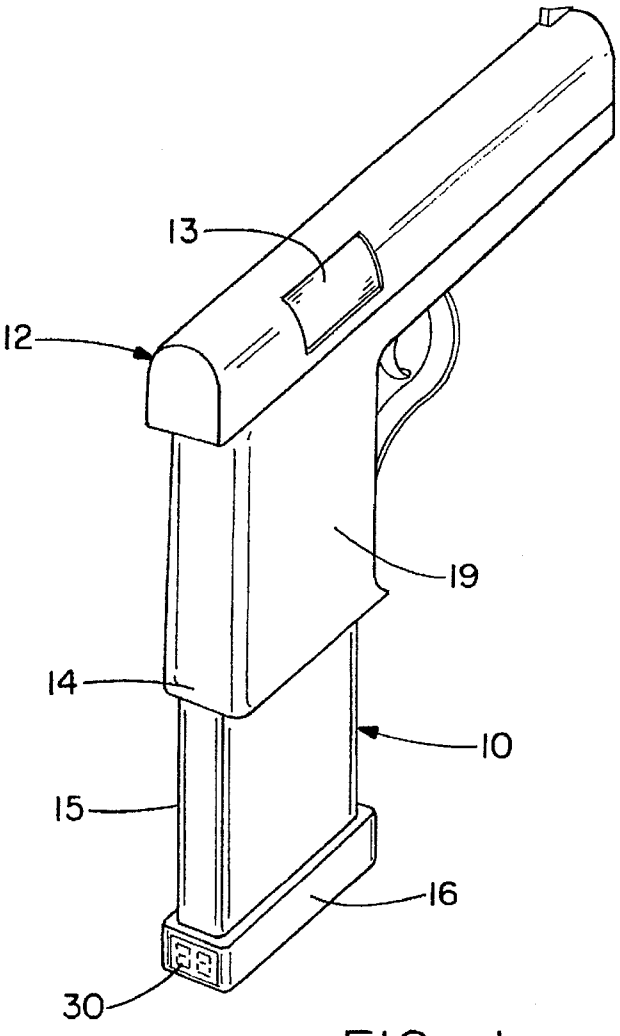
FIG. 1 is perspective view of a firearm including an ammunition magazine in accordance with the present invention.

As shown in FIGS. 2 and 3, lower portion 16 of magazine 10 is attached to hollow upper portion 15 using fasteners such as screws 17, although any other suitable method of attachment may be utilized and is contemplated herein. Alternatively, upper portion 15 and lower potion 16 of magazine 10 may be manufactured as an integral one-piece unit. When magazine 10 is inserted into firearm 12, only the lower portion 16 of magazine 10 extends from the lower butt portion 14 of the firearm handgrip 19. Lower portion 16 of magazine 10 includes a visual display 30 which is preferably rearwardly facing (relative to the direction of bullet travel from the firearm) so as to be easily viewable by the gun user. Visual display 30 is preferably a two digit, seven-segment light emitting diode (LED) display or a similar liquid crystal display (LCD). Visual display 30 is positioned and oriented such that a gun user can easily read the numbers displayed thereon with the gun in a wide variety of positions, including the aiming/firing position. As is discussed in more detail below, display 30 is part of an electronic circuit means contained within lower portion 16 of magazine 10 for determining the number of rounds of ammunition 20 present in the magazine 10 based upon the position of follower 25. The electronic circuit means is also configured to drive the display element 30 thereof such that the number of rounds of ammunition 20 within magazine 10 is visually displayed to the gun user.

Figure 4:
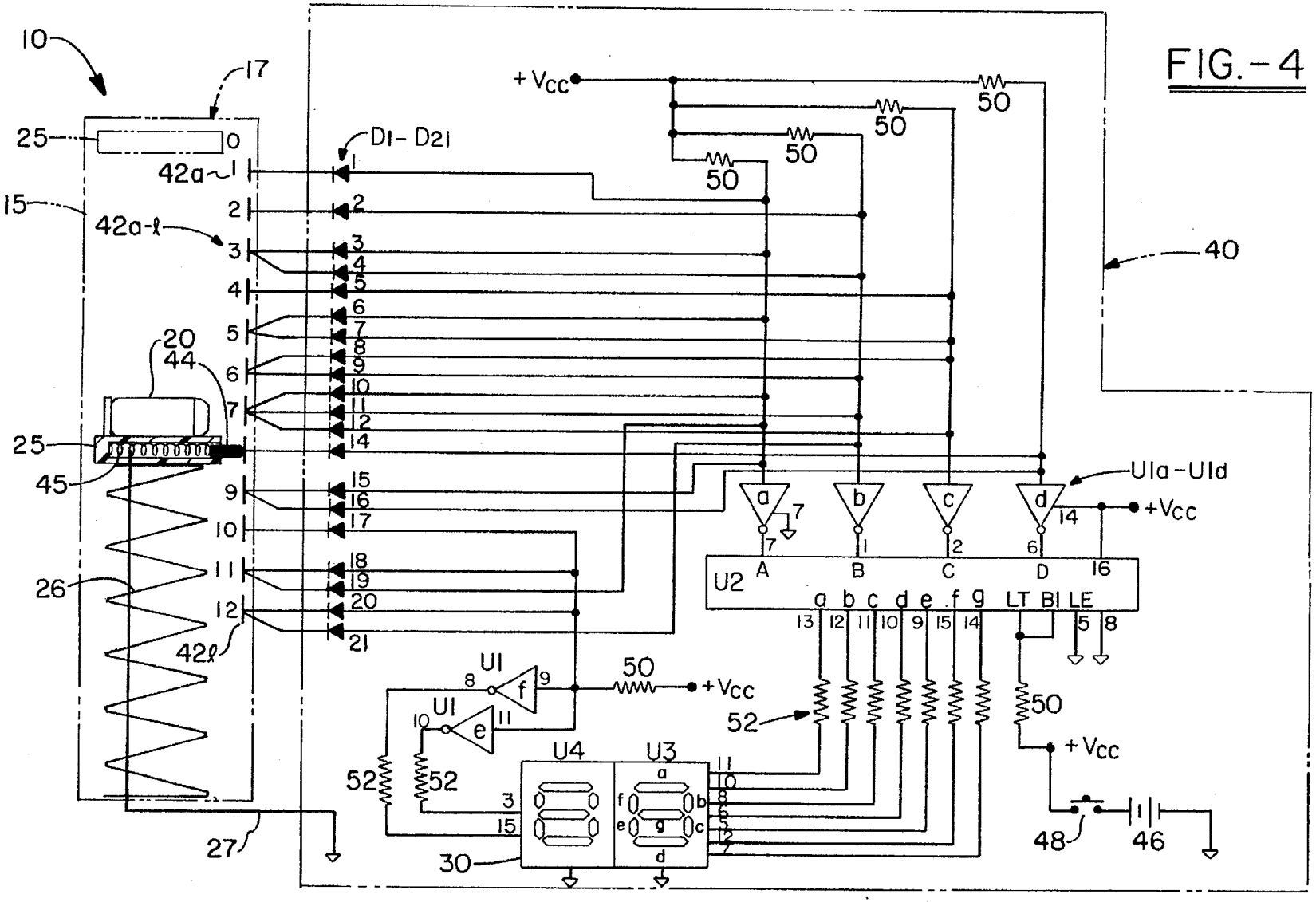
FIG. 4 is a schematic diagram of an electronic circuit that may be incorporated into an ammunition magazine in accordance with the present invention.

Referring now also to FIG. 4, the first embodiment of the present invention is shown schematically at 10. Upper portion 15 of magazine 10 includes sensing means, connected to an electronic circuit 40 (discussed fully below), for sensing the position of follower 25 within upper portion 15 of magazine 10. In the example shown in FIG. 4, the sensing means is provided, in part, by a plurality of contacts 42*a*–42*l* preferably corresponding in number to the total number of rounds of ammunition capable of being loaded into upper portion 15 of magazine 10. Each contact 42*a*–42*l* is electrically insulated from upper portion 15 of magazine 10 which is typically metallic. Follower 25, which is preferably made of an electrically non-conductive material, also includes a contact 44, which forms part of the sensing means for sensing the position of follower 25, and which is preferably a spring-loaded sliding contact 44 which is designed to contact one of contacts 42*a*–42*l* when follower 25 is adjacent thereto. Spring-loaded contact 44 includes a spring 45 which urges contact 44 into engagement with contacts 42*a*–42*l*. Spring-loaded sliding contact 44 is electrically connected to ground using a ground wire 27 or by insulating follower spring 26 and using spring 26 to connect spring-loaded contact 44 to ground potential. Contacts 42*a*–42*l* are also preferably positioned in upper portion 15 of magazine 10 such that for any number of rounds of ammunition 20 loaded into upper portion 15 of magazine 10, one contact 42*a*–42*l* will be adjacent to and contacted by sliding contact 44. This engagement of sliding contact 44 with one of contacts 42*a*–42*l* at each discrete location of follower 25 can be exploited in a variety of ways to determine and display the number of rounds of ammunition 20 within magazine 10. In the example shown, contact 42*a* corresponds to the position of follower 25 when one round of ammunition 20 is present in upper portion 15 of magazine 10. Likewise, contacts 42*b*–42*l* correspond respectively to the position of follower 25 when 2–12 rounds of ammunition 20 are present in upper portion 15 of magazine 10. When upper portion 15 of magazine 10 is empty, follower 25 will be positioned at the open top 17 of upper portion 15 (as is shown in phantom at 25), such that none of contacts 42*a*–42*l* will be connected to spring-loaded contact 44, resulting in the digit "0" being displayed on display element 30.

As shown in FIG. 4, for example, an electronic circuit 40 is provided, preferably within lower portion 16 of magazine 10. As shown herein, circuit 40 includes a voltage source 46 such as one or more batteries. A switch 48 may be provided for selectively connecting voltage source 46 to circuit 40. For example, switch 48 may be positioned such that it is closed automatically when magazine 10 is inserted into firearm 12. Alternatively, switch 48 may be selectively activated by the gun user to connect voltage source 46 to circuit 40 such that display 30 selectively displays the number of rounds of ammunition within magazine 10. When switch 48 is closed, voltage source 46 provides a voltage (Vcc) to components of circuit 40.

Display 30, in the example shown, comprises two Panasonic LN524GK seven segment LED display elements U3 and U4. As shown herein, display element U3 must display the "ones" digit of the display 30 and consequently must be capable of displaying any digit 0–9. Input pins (11,10,8,6, 5,12,7) of display element U3 (each being connected to and controlling one of the seven segments a–g of the display element) are therefore respectively connected to output pins (13,12,11,10,9,15,14) of a 74HC4511 Binary Coded Decimal (BCD) to seven segment decoder driver U2, or an equivalent through current limiting 220 Ohm resistors 52. Display element U4 is designed to display the "tens" digit of display 30 and therefore is needed only if magazine 10 has a capacity of greater than nine rounds of ammunition 20.

BCD to seven segment decoder driver U2 is connected to (Vcc) at input pin 16, while input pins 5 and 8 thereof are tied to ground to establish a logic "low", and input pins LT and BI are pulled to logic "high" by connection to Vcc through a 1 Megohm "pull-up" resistor 50. Decoder driver U2 includes four logic inputs (A,B,C,D) which correspond respectively to BCD bits $2^0$,$2^1$,$2^2$,$2^3$ such that, for example, when inputs A and D of decoder driver U2 are at a logic level "high" and inputs B and C of decoder driver U2 are at a logic "low" (indicating a value of $2^0+2^3$ at the inputs (A,B,C,D), decoder driver U2 will establish the proper logic voltage levels at its output pins (13,12,11,10,9,15,14) such that the decimal value corresponding to the BCD value of $2^0+2^3$, which is 9, is displayed by display element U3. Each logic input pin (A,B,C,D) of decoder driver U2 is respectively tied to (Vcc) through an inverter U1*a*–U1*d*, each of which inverters U1*a*–U1*d* is preferably provided as part of an inverter chip package U1 consisting of 6 inverters U1*a*–U1*f*, such as an MM74HC14 Hex Inverting Schmitt Trigger, and the respective input pin (13,5,3,1) each a inverter U1*a*–U1*d* is initially pulled to a logic "high" by connection to (Vcc) through 1 Megaohm pull-up resistors 50. Inverter package U1 is tied to Vcc at input pin 14 thereof and to ground at output pin 7 thereof.

Display element U4 will preferably be blank or will display the digit "1" as required, and therefore its connection to the remainder of circuit 40 is more simple than the connection of display element U3. However, those skilled in the art will recognize that display element U4 may be connected in a manner similar to display element U3, or an equivalent manner, to display any digit "0"–"9". As shown in FIG. 4, element U4 has input pins 3 and 15, which are connected to and control segments b and c thereof, connected through current limiting resistors 52 to inverters U1*e*,U1*f*, respectively, each of which inverters U1*e*,U1*f* is also preferably provided as a part of inverter package U1. The respective input pins 11,9 of inverters U1*e*,U1*f* are connected to (Vcc) through a 1 Megaohm pull-up resistor 50 to establish a logic "high" at inputs 9,11, thereby also establishing a logic "low" voltage level at their respective outputs 8,10 and inputs 3,15 of display element U4 (assuming less than 9 rounds of ammunition 20 are present in upper portion 15 of magazine 10).

Referring again to upper portion 15 of magazine 10, it can be seen that each contact 42*a*–42*l* is tied to the cathode of at least one diode (D1–D21). The anode of each diode (D1–D21) is to tied to an input (1,3,5,13,9,11) of inverters (U1*a*,U1*b*,U1*c*,U1*d*,U1*f*,U1*e*). It can be seen that, for example, contact 42*a* will be contacted by spring-loaded contact 44 of follower 25 when one round of ammunition 20 is present in magazine 10. In order to display a "1" on display element U3 when follower 25 is in this position as described, input A of BCD decoder driver U2 must be a logic "high" requiring the input 13 of inverter U1*a* to be pulled "low". The remaining inputs (B,C,D) of decoder driver U2 should remain low, and therefore, the inputs (5,3,1) to their respective inverters U1*b*–U1*d* need to remain "high". Consequently, contact 42*a* must only be tied to one diode D1. Anode of diode D1 is tied to input 13 of inverter U1*a* such that when spring-loaded sliding contact 44 of follower 25 is adjacent to and contacting contact 42*a*, thereby pulling input 13 of inverter U1*a* to a reference potential or logic "low" voltage, input A of decoder driver U2 will be pulled "high" by virtue of its connection to output pin 12 of inverter U1*a* causing a "1" to be displayed on display element U3. The remaining contacts 42*b*–42*i* are likewise configured and connected to inputs 1,3,5,13 of inverters (U1*d*,U1*c*,U1*b*, U1*a*) such that the required inputs 1,3,5,13 of inverters (U1*d*,U1*c*,U1*b*,U1*a*) are pulled "low" due to a connection between spring-loaded contact 44 and one of contacts 42*b–i*. As is discussed above, one or more diodes D1–D16 are connected between contacts 42*a–*42*i* such that current flows from (Vcc) to ground through pull-up resistors 50 when contact is made between spring-loaded contact 44 and one of contacts 42*a–*42*i*. Using the particular configuration shown in FIG. 4, the number of diodes that need to be connected to each contact 42*a–*42*i* is equal to the number of connections needed between each contact 42*a–*42*i* and inputs (1,3,5,13) of inverters (U1*d*,U1*c*,U1*b*,U1*a*). Those skilled in the art will recognize that the number of connections needed between each contact 42*a–*42*i* and inputs (1,3,5,13) of inverter package U1 is equal to the number of "1" bits needed in the BCD bit pattern for each digit ("1"–"9" respectively) that must be displayed by display element U3. As another example, shown in FIG. 4, follower 25 will be adjacent to contact 42*h* when 8 rounds of ammunition 20 are present in magazine 10 (only one round of ammunition 20 is shown). The digit "8" is encoded in BCD as "1000" which represents $2^3$. Therefore, the only inverter of package U1 that needs to be affected is U1*d*. Electrical connection between spring-loaded contact 44 and contact 42*h* pulls input pin 1 of inverter U1*d* to a logic "low" voltage state, thereby causing input D of decoder display chip U2 to be pulled "high". The input pins (A,B,C) of decoder driver U2 will not be affected and will remain "low". Therefore, decoder driver chip U2 will cause the value of $2^3$ or "8" to be displayed on display element U3. In general therefore, it can be seen that for each position of follower 25 within upper portion 15 of magazine 10, a unique input voltage pattern to circuit 40 will be provided from the sensing means such as contacts 44 and 42*a–*42*l*. Circuit 40 can interpret each unique voltage pattern as discussed above to display the number of rounds of ammunition 20 present in magazine 10.

When more than 9 rounds of ammunition 20 are present in magazine 10, display element U4 must be utilized to provides a "tens" digit to the display 30. In the example shown, display element U4 will remain blank when 0–9 rounds of ammunition 20 are present within magazine 10. However, in a manner similar to that described above in relation to display element U3, display element U4 will display the digit "1" when follower 25 is adjacent to any of contacts 42*j–*42*l* as will occur in the present example when magazine 10 contains 10, 11, or 12 rounds of ammunition 20, respectively. It can be seen that each contact 42*j–*42*l* must also be connected to the appropriate input pins 1,3,5,13 of inverter package U1, as is discussed above, to cause the proper "ones" digit to be displayed simultaneously with the tens digit "1". Contact 42*j*, which will be contacted by spring-loaded contact 44 when 10 rounds of ammunition 20 are present in magazine 10 is not connected to any of the input pins (1,3,5,13) of inverter package U1 because, when 10 rounds of ammunition 20 are present in magazine 10, the "ones" digit that needs to be displayed is "0". Each contact 42*j–*42*l* must also be connected to input pins 9,11 of inverter package U1. Inputs 9,11 of inverter package U1 are also connected to (Vcc) through a common 1 Megaohm pull-up resistor 50 to establish an initial logic voltage value of "high" at inputs 9,11 of inverter package U1, and consequently establish a logic "low" voltage level at outputs 8,10 of inverter package U1 and also inputs 3,15 of display element U4 so that display element U4 will initially be blank. However, when spring-loaded contact 44 of follower 25 contacts a contact 42*j–*42*l*, thereby completing a circuit between (Vcc) and ground through a pull-up resistor 50, both inputs 9,11 of inverter package U1, along with the appropriate "ones digit" input pins 1,3,5,13 of inverter package U1, will be pulled to a logic "low" voltage potential. This will cause both inputs 3,15 of display element U4 to be pulled high, resulting in the digit "1" being displayed thereon. Also, the relevant inputs (A,B,C,D) of decoder driver U2 will be pulled to a logic "high" voltage level so that the appropriate "ones" digit is simultaneously displayed on display element U3.

By preventing the reverse flow of current from each contact 42*a–*42*l*, diodes D1–D21 allow each contact 42*a–*42*l* to be multiplexed or connected to more than one input (1,3,5,13,9,11) of inverter package U1. For example, as shown in FIG. 4, when 8 rounds of ammunition 20 are present in magazine 10, input pin 1 of inverter U1*d* is pulled "low" by virtue of the connection between contacts 44,42*h*. Without the presence of diode D16, input pin 1 of inverter U1*d* would be pulled back to "high" due to the connection of contact 42*i* with input pin 1 of inverter U1*d*, and also with (Vcc) at input 13 of inverter U1*a*. Diodes D1–D21 also stop erroneous readings by preventing the metallic ammunition cartridges 20 stacked on follower 25 (only one shown) from accidentally establishing an improper voltage level at one of the inputs (1,3,5,13) of inverter package U1. For example, as is shown in FIG. 4, a voltage potential (Vcc) exists at all contacts except 42*h* which is grounded. If a metallic ammunition cartridge 20 was to contact any contact 42*a–*42*g*, 42*i–*42*l*, that ammunition cartridge 20 and any others touching it would be connected to (Vcc). If a second contact 42*a–*42*g*, 42*i–*42*l* was then contacted by an charged ammunition cartridge 20, an improper voltage level at inputs (1,3,5,13) of inverter package U1 could result. Diodes D1–D21 therefore prevent a voltage potential from being established at inputs 1,3,5,13 by virtue of their connection to an accidentally charged round of ammunition 20 and contact 42*a–*42*l*. Also, those skilled in the art will recognize that an ammunition magazine 10 in accordance with the present invention may be provided with a switch for consistently increasing the displayed value by one so that a gun user can selectively increase the displayed number of rounds of ammunition 20 in the firearm 12 by one to account for the situation where the firearm includes a fully loaded magazine 10 as well as a round of ammunition 20 in the chamber, or any other situation where the gun user desires that the total number of rounds of ammunition 20 in the firearm 12 be displayed, rather than simply the number of rounds of ammunition 20 in the magazine 10.

Figure 6:
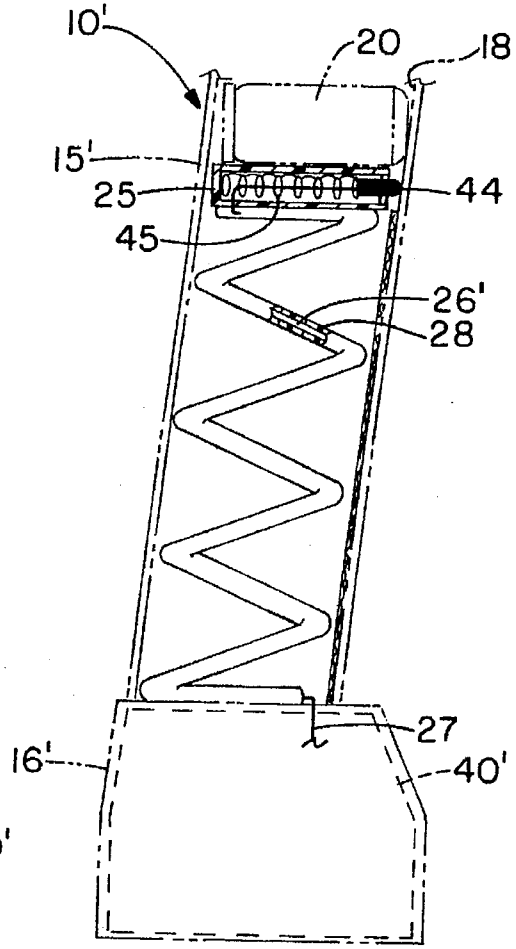
FIG. 6 is partial schematic view of an alternative embodiment of the present invention.
Figure 5:
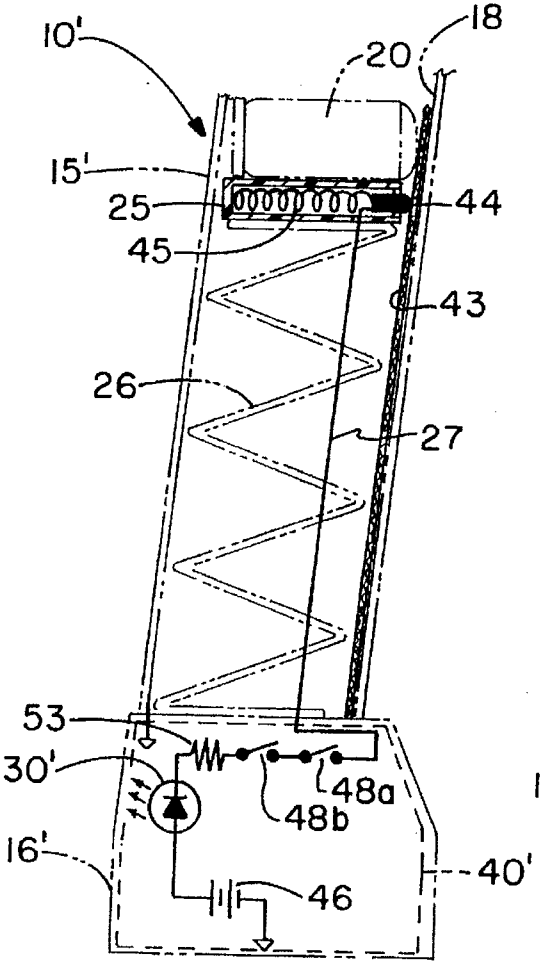
FIG. 5 shows a schematic view of an alternative embodiment of the present invention.

A simplified embodiment of the present invention is shown schematically at 10' in FIG. 5 wherein upper portion 15' of magazine 10 is electrically connected to ground potential as shown and follower 25 is equipped with a spring-loaded contact 44 which is electrically tied to an electronic circuit 40' through an electrical current conducting path such as a wire 27. Alternatively, as is shown in FIG. 6, metallic follower spring 26' may be insulated with any suitable insulating material 28 to form an electrical current path 27 to circuit 40' such that spring-loaded contact 44 may be electrically connected to circuit 40' directly through follower spring 26'. Although not required, follower spring 26' may be specially shaped to minimize contact with metallic upper portion 15 of magazine 10, such that friction between insulation 28 of spring 26' and upper region 15' of magazine 10 is minimized. Insulation 28 may be provided in any suitable form, and it is thought preferable to provide insulation 28 in one or more cylindrical plastic or similar segments as shown rotatably positioned around spring 26' to further minimize friction between insulation 28 and upper portion 15' of magazine 10'. In all other respects, magazine 10' shown in FIG. 5, and that partially shown in FIG. 6 are identical.

Referring then to lower portion 16' of magazine 10', it can be seen that lower portion 16 includes an electrical circuit 40' including a display element 30' designed to indicate to the gun user when the level of ammunition 20 within upper portion 15' of magazine 10' has dropped below a predetermined level or threshold. Circuit 40' preferably includes one or more switches **48*a*,48*b* such that a gun user can selectively control the operation of circuit 40'. For example, one of switches 48*a*,48*b* can be positioned and configured to close automatically when magazine 10' is inserted into firearm 12, and the other of switches 48*a*,48*b* can be operable by the gun user to selectively operate circuit 40'. In this manner, circuit 40' will be inoperable unless magazine 10' is properly inserted into firearm 12. In the example shown, display element 30' is provided by an LED which will turn on and off (illuminate or extinguish) depending upon the number of rounds of ammunition 20 present in upper portion 15' of magazine 10'**.

In general, it can be seen that spring-loaded contact 44 moves up and down within upper portion 15 of magazine 10' in conjunction with follower 25. Spring-loaded contact 44 includes a spring 45 which constantly urges contact 44 toward inner wall 18 of upper portion 15'. Inner wall 18 includes an exposed portion which acts as a second contact and those skilled in the art will recognize that any time contact 44 touches an exposed portion of wall 18 (or any other non-insulated part of upper portion 15') circuit 40' will be completed (assuming switches **48*a*,48*b* are closed) thereby providing an alternative means for sensing the position of follower 25 within upper portion 15' of magazine 10'. When circuit 40' is completed, LED 30' will illuminate. A current limiting resistor 53 is provided in circuit 40' to prevent excessive current from flowing therethrough. Therefore, as shown in FIGS. 5 and 6, an insulator material such as insulating strip 43 is positioned along an interior portion of wall 18 of upper portion 15' of magazine 10' to selectively prevent contact 44 from contacting wall 18. In the example shown, it can be seen that LED 30' will remain unlighted any time upper portion 15' contains sufficient rounds of ammunition 20 such that follower 25 is pushed downward within upper portion 15' so that it is adjacent to insulator strip 43. As rounds of ammunition 20 are emptied from upper portion 15', follower 25 is pushed upward by follower spring 26'. It can therefore be seen that contact 44 will contact wall 18 at some predefined point where strip 43 ends, and wall 18 is exposed. As shown, LED 30' will illuminate when upper portion 15' is approximately half empty. However, by changing the length of insulating strip 43, any other predetermined illumination point can be defined. For example, insulating strip 43 can be sufficiently long such that LED 30' will not illuminate until upper portion 15' of magazine 10' is empty. Also, magazine 10' can be configured where LED 30' is normally illuminated and becomes extinguished at a certain predefined level of ammunition 20**.

Figure 7A:
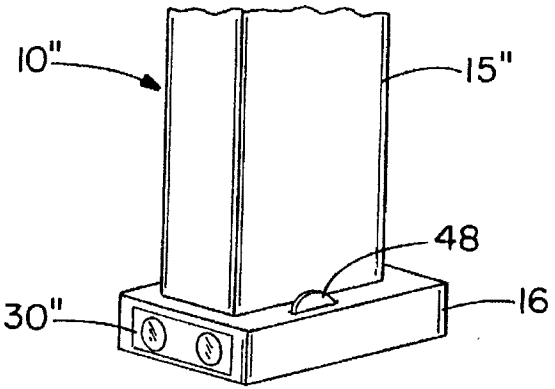
FIG. 7A is a partial perspective view of another alternative embodiment of an ammunition magazine in accordance with the present invention.
Figure 7B:
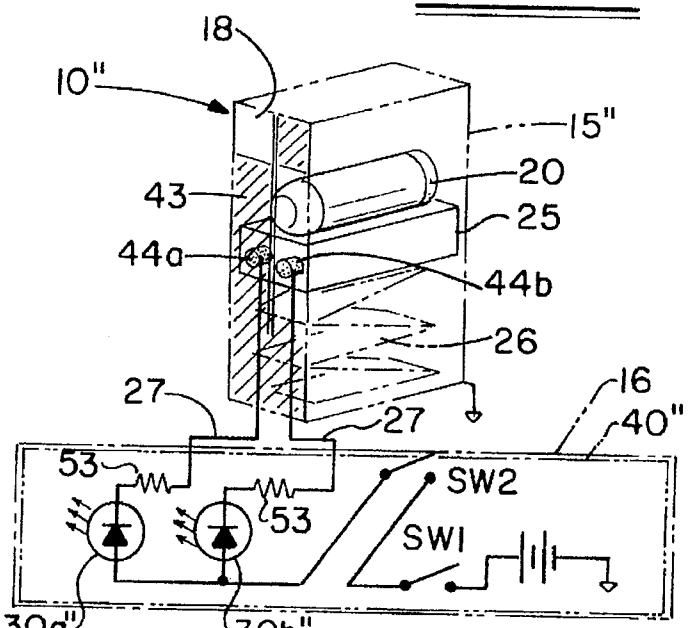
FIG. 7B is a partially schematic, partially perspective view of the ammunition magazine shown in FIG. 7A.

FIGS. 7A and 7B show a further variation of a magazine in accordance with the present invention at 10" which is closely related to magazine 10' wherein follower 25 includes two spring-loaded contact **44*a*,44*b*, each respectively connected to a separate LED 30*a*",30*b*" using current conducting wires 27. As is shown most clearly in FIG. 7B, inner wall 18 of upper portion 15" includes an insulation strip 43 which is shaped and positioned such that spring-loaded contacts 44*a*,44*b* will contact wall 18 at various different positions of follower 25 within upper portion 15". LED's 30*a*",30*b*" are therefore preferably different in color such that the gun user can easily distinguish therebetween. In the example shown, it can be seen that both LED's 30*a*",30*b*" will remain unlighted when magazine 10" is full or nearly full and follower 25 is positioned approximately in the lower half of magazine 10". As rounds of ammunition 20 are taken from magazine 10", follower 25 will move upward as previously discussed. Insulating strip 43 is shaped such that when upper portion 15" of magazine 10" is approximately half empty, spring-loaded contact 44*b* will be moved into contact with wall 18 thereby completing a path for electrical current to flow through LED 30*b*". As follower 25 continues to move upward to a point where upper portion 15" is emptied of ammunition 20, spring-loaded contact 44*b* will once again be prevented from contacting wall 18 due to the placement of insulating strip 43 (causing LED 30*b*" to extinguish), while spring-loaded contact 44*a* will be able to contact wall 18 due to the lack of any insulating strip 43 adjacent to contact 44*a* when follower 25 is at the uppermost position, thereby lighting LED 30*a*" and indicating to the gun user that magazine 10"** is empty.

Figure 8A:
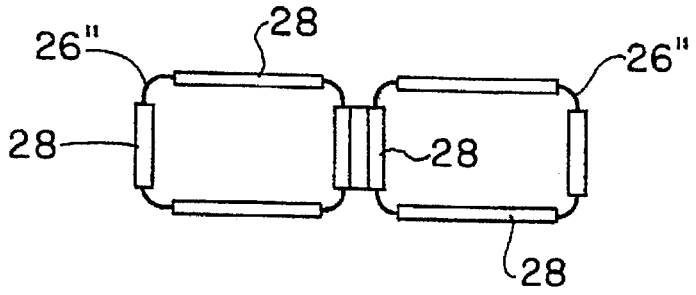
FIGS. 8A and 8B are a top plan view and a side elevational view, respectively, of an insulated electrically conductive follower spring that may be utilized in conjunction with the ammunition magazine shown in FIGS. 7A and 7B.
Figure 8B:
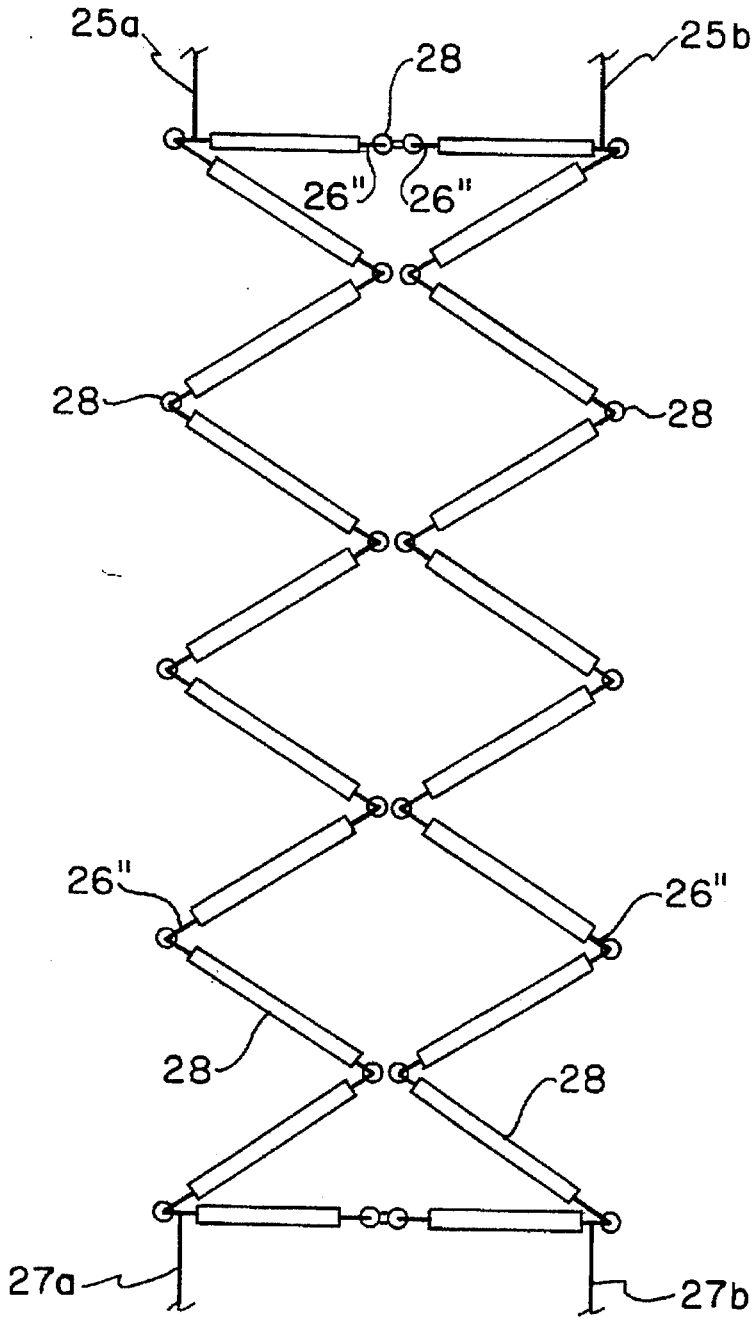

As is shown in FIGS. 8A and 8B, insulated follower spring 26" may be used in conjunction with the magazine 10" as an alternative to wire 27 to connect spring-loaded contacts **44*a*,44*b* with circuit 40" in a manner similar to that described in relation to insulated spring 26'. Because follower 25 of magazine 10" includes two separate spring-loaded contact 44*a*,44*b*, follower spring 26" includes two separate current conducting paths 27*a*,27*b* which are insulated from one another and from upper portion 15" of magazine 10" by insulators 28**.

It can be seen from the foregoing that the present invention provides an ammunition magazine for a firearm including a self-contained system for accurately sensing and displaying the number of ammunition rounds remaining in the magazine, without requiring the firearm to be modified. Those skilled in the art will recognize that various modifications can be made to the present invention as disclosed herein without departing therefrom. For example, any mechanical contacts could easily be replaced using Hall effect sensors or optical means for sensing the position of the follower within the ammunition magazine. Also, any wired connections could be replaced with wireless connections such as optical, sonic, radio frequency, or other similar wireless connections. A wide variety of different electrical components and connections may be utilized in addition to the particular preferred embodiments as disclosed herein. In general, the foregoing description has set forth the preferred embodiment of the invention in particular detail and it must be understood that numerous modifications, substitutions and changes can be undertaken without departing from the true spirit and scope of the present invention as defined by the ensuing claims.

What is claimed is:

1. An ammunition magazine for a firearm, said magazine comprising:

an upper portion for containing at least one round of ammunition, said upper portion of said magazine including an ammunition follower movably positioned therein for supporting said at least one round of ammunition within said upper portion of said magazine, said upper portion of said magazine also including a follower spring for biasing said follower toward an end of said upper portion of said magazine;

sensing means provided as a part of said ammunition magazine for sensing the position of said follower within said upper portion of said magazine; and, a circuit, including a display element, said circuit provided as a part of said ammunition magazine and connected to said sensing means for determining and displaying to a firearm user information regarding the number of rounds of ammunition in said upper portion of said magazine based upon the position of said ammunition follower within said upper portion of said magazine, whereby said ammunition magazine provides a self-contained ammunition counting and display system, independent from a firearm.

2. An ammunition magazine as recited in claim 1, wherein said sensing means comprises at least one first contact connected to said ammunition follower to be movable therewith, and at least one second contact within said upper portion of said magazine, wherein said at least one first contact and said at least one second contact connect with one another at a predefined location of said follower within said upper portion of said magazine, thereby causing said display element of said circuit means to display a visual indication regarding the number of rounds of ammunition present in said magazine.

3. An ammunition magazine as recited in claim 2, wherein said at least one second contact is provided by an exposed portion of an inner metallic wall of said upper portion of said magazine, and wherein said upper portion of said magazine further comprises an insulating strip to selectively prevent said at least one first contact from contacting said exposed portion of said inner wall.

4. An ammunition magazine as recited in claim 3, wherein said first contact is provided by a spring-loaded contact including a spring for urging said first contact into engagement with said inner metallic wall.

5. An ammunition magazine as recited in claim 2, wherein said display element of said circuit comprises at least one light emitting diode for illuminating when said at least one first contact engages said at least one second contact.

6. An ammunition magazine as recited in claim 2, wherein said at least one follower spring is insulated, and wherein said at least one follower spring is connected to said at least one first contact such that at least one current conducting path is defined through said follower spring.

7. An ammunition magazine as recited in claim 1, wherein said sensing means comprises a first contact connected to said ammunition follower to move therewith within said upper portion of said magazine, and comprises a plurality of second contacts positioned at predetermined locations within said upper portion of said magazine, such that said first contact connects with one of said second contacts when said follower is adjacent thereto.

8. An ammunition magazine as recited in claim 7, wherein said display element of said circuit is provided by at least one seven-segment display.

9. An ammunition magazine as recited in claim 7, wherein said first contact of said sensing means is provided by a spring-loaded contact.

10. An ammunition magazine as recited in claim 8, wherein said seven-segment display is driven by a decoder driver including a plurality of logic input pins, and wherein each of said plurality of second contacts is connected to at least one of said logic input pins, such that contact between said first contact and one of said plurality of second contacts causes said seven-segment display to display a numeric digit.

11. An ammunition magazine as recited in claim 7, wherein said at least one follower spring is insulated and a current conducting path from said first contact is defined therethrough.

12. An ammunition magazine as recited in claim 10, wherein each of said plurality of second contacts is further connected to a voltage source such that a first voltage level is established at each of said logic input pins to said decoder driver, and such that contact between said first contact and one of said plurality of second contacts causes said first voltage level to change to a second voltage level for at least one of said logic input pins of said decoder driver.

13. An ammunition magazine as recited in claim 10, wherein each of said plurality of second contacts is connected to at least one of said logic input pins of said decoder driver through a diode, wherein each of said plurality of second contacts is connected to a cathode of said diode, and each of said logic input pins of said decoder driver is connected to an anode of said diode.

14. An ammunition magazine as recited in claim 8, wherein said display element of said circuit displays a two-digit value representing the number of rounds of ammunition present in said ammunition magazine, wherein said display element comprises a first seven-segment display element for displaying a ones digit, and a second seven-segment display element for displaying a tens digit.

15. An ammunition magazine comprising:

a hollow upper portion for containing a plurality of rounds of ammunition;

a follower slidably disposed within said hollow upper portion;

a follower spring for biasing said follower toward an end of said upper portion;

a circuit, including a display element, for determining and displaying the number of rounds of ammunition in said upper portion of said magazine; and, sensing means connected to said circuit for sensing the position of said follower within said upper portion of said magazine, said circuit and said sensing means being self-contained as a part of said ammunition magazine, separable from and independent of a firearm.

16. An ammunition magazine as recited in claim 15, wherein said sensing means is provided by:

a first contact connected to said follower to move therewith;

and a plurality of second contacts positioned at predetermined locations within said upper portion of said magazine, each of said plurality of second contacts connected to said circuit;

whereby, for at least one position of said follower within said upper portion of said magazine, at least one of said plurality of second contacts will be connected to said first contact, thereby establishing a unique input voltage pattern to said circuit such that said circuit determines and displays visual information relating to the number of rounds of ammunition present within said upper portion of said magazine based upon said unique input voltage pattern.

* * * * *